US006846077B2

(12) United States Patent
Bich et al.

(10) Patent No.: US 6,846,077 B2
(45) Date of Patent: Jan. 25, 2005

(54) LIQUID JET WRITING INSTRUMENT

(75) Inventors: Xavier Bich, Neuilly sur Seine (FR); Alain Rosenzweig, Saint Maur des Fosses (FR); Kurt Rath, Asniéres sur Seine (FR)

(73) Assignee: Societe BIC (FR)

( * ) Notice: Subject to any disclaimer, the term of this patent is extended or adjusted under 35 U.S.C. 154(b) by 40 days.

(21) Appl. No.: 10/607,548

(22) Filed: Jun. 26, 2003

(65) Prior Publication Data

US 2004/0052569 A1 Mar. 18, 2004

(30) Foreign Application Priority Data

Jun. 28, 2002 (FR) ..... 02 08109

(51) Int. Cl.[7] ..... B41J 3/36; B43K 29/00
(52) U.S. Cl. ..... 347/109; 410/195
(58) Field of Search ..... 347/109, 108; 401/195

(56) References Cited

U.S. PATENT DOCUMENTS

| | | | |
|---|---|---|---|
| 4,412,232 A | 10/1983 | Weber et al. | |
| 4,746,936 A | 5/1988 | Takahashi | |
| 4,748,460 A | 5/1988 | Piatt et al. | |
| 5,501,535 A | 3/1996 | Hastings et al. | |
| 5,757,498 A | 5/1998 | Klein, II et al. | |
| 5,902,968 A | 5/1999 | Sato et al. | |
| 5,927,872 A | 7/1999 | Yamada | |
| 5,928,711 A | 7/1999 | Wallace et al. | |
| 6,523,920 B2 | 2/2003 | Wade et al. | |
| 6,543,874 B2 | 4/2003 | Matsumoto | |
| 2003/0063943 A1 | 4/2003 | Lapstun et al. | |
| 2003/0118391 A1 * | 6/2003 | Adams | 401/116 |
| 2003/0118393 A1 | 6/2003 | Lapstun et al. | |

FOREIGN PATENT DOCUMENTS

| | | |
|---|---|---|
| DE | 44 19 735 A1 | 12/1995 |
| EP | 0 629 156 B1 | 5/1997 |
| EP | 0 931 649 A2 | 7/1999 |
| EP | 1 000 758 A1 | 5/2000 |
| GB | 2 343 867 A | 11/1991 |
| WO | WO 00/48654 | 8/2000 |
| WO | WO 01/30589 A1 | 5/2001 |

* cited by examiner

*Primary Examiner*—Stephen D. Meier
*Assistant Examiner*—Alfred Dudding
(74) *Attorney, Agent, or Firm*—Jones Day

(57) ABSTRACT

A writing instrument comprising a liquid reservoir for containing a liquid, a liquid spray head for spraying liquid, the spray head serving to spray the liquid onto a medium from a distance, and a processor unit serving to activate the spray head. The instrument further comprises measurement means for measuring the distance between the spray head and the medium, and movement detector means for detecting movement of the spray head relative to the medium, the processor unit being adapted to cause the liquid spray head to be activated when both the measurement means detect that the distance between the spray head and the medium is less than a predetermined maximum value, and simultaneously the movement detector means detect movement of the spray head relative to the medium.

15 Claims, 3 Drawing Sheets

LIQUID JET WRITING INSTRUMENT

FIELD OF THE INVENTION

The present invention relates to writing instruments that spray jets of liquid such as ink. More particularly, among such writing instruments, the present invention relates to a writing instrument having a liquid reservoir for containing a liquid, and a liquid spray system for spraying liquid onto a medium from a distance, the liquid spray system being activated to enable the spray head to spray the liquid onto the medium from a distance.

BACKGROUND OF THE INVENTION

In such a known writing instrument of this type, the tubular element generally has a feeler having a first end serving to come into contact with the medium during writing, and a second end connected to a movement detector mechanism for detecting movement of the feeler in contact with the medium. That movement detector mechanism is connected to the processor unit to enable the liquid spray system to be activated. Thus, when the user holds the writing instrument in the hand and moves it towards the medium, the feeler comes into contact with the surface of the medium, thereby enabling the detector mechanism to send a signal to the processor unit to activate spraying of the liquid.

Therefore, although the writing head, namely the liquid spray head, does not need to be in contact with the medium, it is nevertheless essential for the feeler of the writing instrument to be in contact with the medium in order to be able to start spraying the liquid. It can be inconvenient for the user to put the feeler into contact with the medium, in particular when said medium is rough to some extent.

In addition, since the end of the feeler in contact with the medium is generally close to the point of impact of the spray of liquid on the medium, there are major risks that the end of the feeler might come into contact with the liquid before it dries, thereby smearing it over the medium while the writing instrument is in normal use.

Finally, the feeler, which necessarily extends beyond the liquid spray head, can also be subjected to a sudden impact, giving rise to irreparable damage to the detector mechanism, thereby causing the entire writing instrument to be put out of operation.

SUMMARY OF THE INVENTION

The present invention mitigates the above-mentioned technical problems by proposing a writing instrument that is reliable, that is simple, and that procures good writing comfort for the user.

To this end, the invention provides a writing instrument having measurement means for acting without physical contact between the writing instrument and the medium to measure the distance between the spray head and the medium. The measurement means is connected to a processor unit. In addition, the writing instrument includes movement detector means for detecting movement of the spray head. The movement detector means is also connected to the processor unit.

The processor unit is adapted to cause the liquid spray system to be activated when both the measurement means determine that the distance between the spray head and the medium is less than a predetermined maximum value, and, simultaneously, the movement detector means detect movement of the spray head.

The writing instrument of the present invention no longer comes into contact with the medium onto which the liquid is to be sprayed, and the user of the instrument causes ink spraying to be activated merely by bringing the instrument up to a suitable distance from the medium, while also imparting movement to the writing instrument. Activation of the liquid spray can thus be stopped by the user, either by ceasing to move the hand, and therefore ceasing to move the instrument, or by taking the writing instrument, or more exactly the liquid spray head, away from the medium. This writing instrument thus makes it possible to cause liquid to be sprayed or not sprayed under good conditions which come close to the writing conditions currently known with conventional writing instruments such as ball-point pens or felt-tip pins, but without requiring any physical contact with the writing medium.

Various embodiments of the invention may additionally include any of the following provisions:

The processor unit may be adapted to cause the liquid spray system to be activated when both the measurement means determine that the distance between the spray head and the medium lies in the range defined by a predetermined minimum value and a predetermined maximum value, and simultaneously the movement detector means detect movement of the spray head;

the measurement means may include an optical system serving to measure the distance between the spray head and the medium;

the movement detector may be formed by the optical system and the processor unit which detects displacements of the spray head relative to the medium as a function of the distances measured by the optical system;

the measurement means may have an ultrasonic acoustic probe serving to measure the distance between the spray head and the medium;

the movement detector means may be formed by an acoustic probe and the processor unit which detects displacements of the spray head relative to the medium as a function of the distances measured by the acoustic probe;

the movement detector means may include an accelerometer;

the tubular element may include an electrical power source and switch-on means connected to the electrical power source, the switch-on means being actuatable by the user for the purpose of switching on the liquid spray system, the processor unit, and the measurement means and the movement detector means;

the tubular element may include means for emitting a visible light spot onto the medium so as to represent the point of impact of the liquid spray on the medium;

the liquid spray head may comprise at least one spray nozzle for spraying droplets of liquid, and the spray system may further comprise an electrical signal generator for causing the at least one nozzle of the spray head to be activated;

the tubular element may have an outside wall on which selector means are mounted for selecting the size of the droplets, the selector means being connected to the electrical signal generator of the spray system to vary the frequency and/or the amplitude of the electrical signals that cause the at least one spray nozzle to be activated;

the processor unit may be adapted to activate communication means serving to emit a warning signal to the user when both the measurement means detect that the distance between the spray head and the medium is less than a predetermined maximum value, and simultaneously the movement detector means have not detected any movement of the spray head over a predetermined time interval; and when the liquid spray system has not been activated for a first time interval, the processor unit may be adapted to activate communication means for a second time interval, which communication means serve to emit a warning signal, and then to cause the liquid spray system to be activated when the measurement means detect that the distance between the spray head and the medium is once again less than the predetermined maximum value, and simultaneously the movement detector means detect movement of the spray head once again.

BRIEF DESCRIPTION OF THE DRAWINGS

Other characteristics and advantages of the invention appear upon reading the following description of embodiments of the invention, given by way of non-limiting example, and with reference to the accompanying drawings.

In the drawings.

DETAILED DESCRIPTION OF THE INVENTION

In the figures, like references designate elements that are identical or similar.

Figure 1:
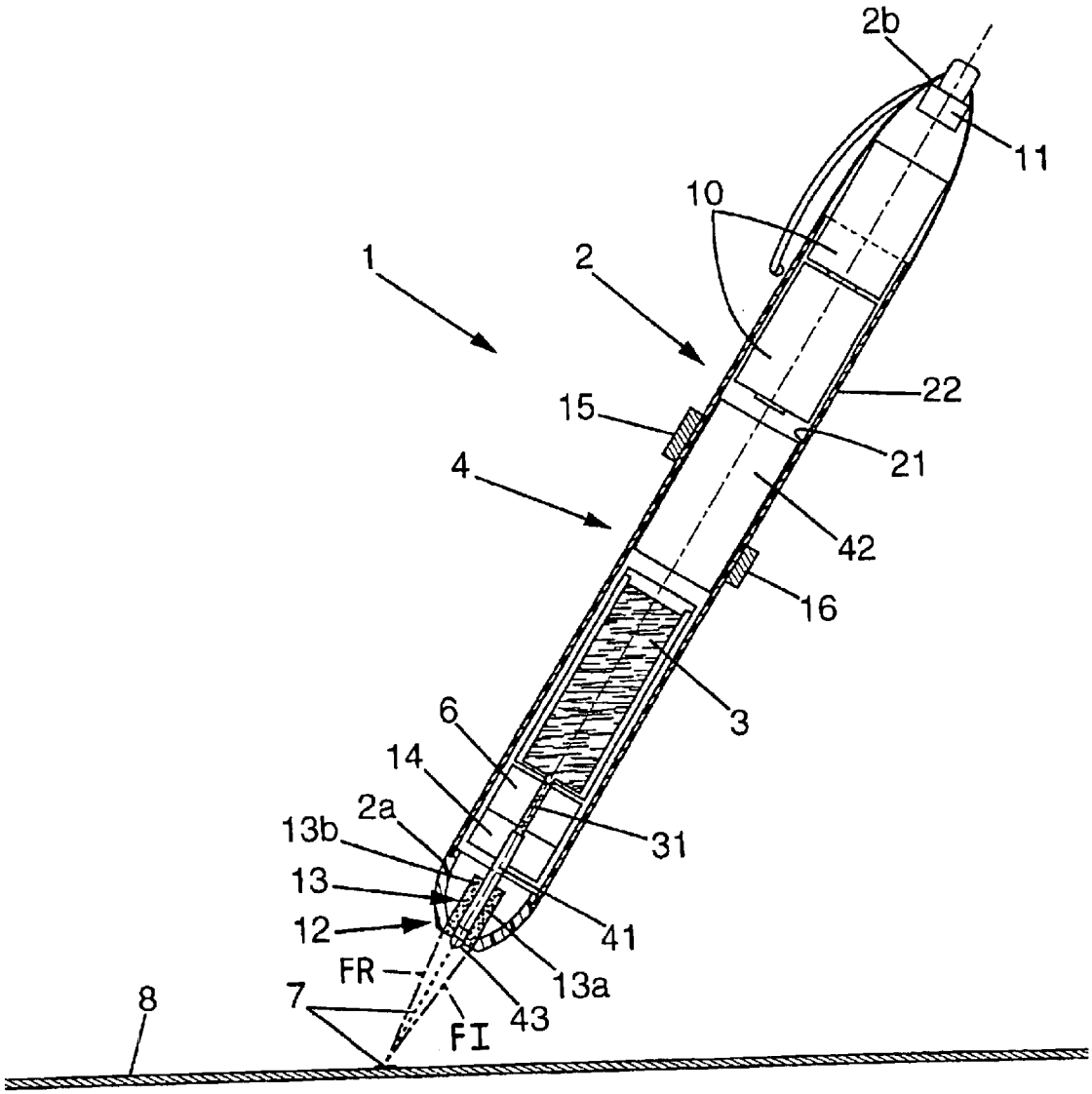
FIG. 1 is a diagrammatic cross-sectional view of a first embodiment of a writing instrument of the invention.

FIG. 1 shows a writing instrument 1 which has a substantially tubular element 2 that extends between a first end 2*a* and a second end 2*b*. The tubular element 2 has an inside wall 21 defining a hollow internal space, and an outside wall 22 designed to be held in the hand of a user.

The hollow internal space defined by the inside wall 21 of the tubular element 2 contains a reservoir 3 of liquid and a spray system 4 for spraying the liquid. The spray system 4 is directly associated with the reservoir 3. The liquid reservoir 3 is mounted removably in the hollow internal space in the tubular element 2 so as to be replaced by another reservoir once the liquid has run out. Depending on what the instrument is used for, the liquid contained in the reservoir may be formed by an ink, or by an ink-erasing or ink-masking liquid when the instrument is used as a corrector, or indeed by an adhesive when the instrument is used as an adhesive applicator or spray. The spray system 4 is formed by a liquid spray head 41 that is connected directly via a channel 31 to the liquid reservoir 3, and by an electrical signal generator 42 serving to control activation or deactivation of the spray head 41, as diagrammatically illustrated in FIG. 2.

In the example considered herein, the spray head 41 is a piezoelectric effect spray head including a spray nozzle 43 disposed at the end 2*a* of the tubular element 2. The end 2*a* of the tubular element may be constituted by an end-piece fitted directly into the inside wall 22 of the central portion of the tubular element 2. The end-piece is provided with an end orifice in which the nozzle 43 of the spray head 41 is disposed. The spray nozzle 43 may be mounted in a fixed manner on the end-piece 2*a*, or in a manner such as to be retractable by means of a suitable mechanism in order to receive the nozzle 43 inside the end-piece, thereby avoiding any risk of the nozzle being damaged while the writing instrument is not in use. In a manner known per se, the spray head 41 includes a piezoelectric element adapted to deform when it is subjected to the electrical signals coming from the generator 42, thereby forming micro-droplets 7 at the spray nozzle 43, which micro-droplets are sprayed onto the medium 8.

The liquid spray system 4 may also be formed by a substrate, e.g., made of glass, on which at least one resistive heater element is mounted, positioned at at least one channel of small size containing a small quantity of ink coming from the reservoir 3. Thus, when an electrical signal is applied from the generator 41 to the resistive element, the temperature of the resistive element increases instantly, thereby forming a bubble of vapor in the ink, which bubble expels a fine droplet 7 of liquid onto the medium 8.

The liquid spray system 4 may also be formed by at least one cartridge of compressed gas. The cartridge serves to co-operate with an air expander mechanism and with a cartridge of liquid. The expander mechanism may comprise a punch serving to release the gas contained in the cartridge into a pressurized antechamber, and a plurality of valves for controlling the flow rate of gas to a nozzle that is also connected to the liquid reservoir 3.

The writing instrument 1 also has a processor unit 6 serving to activate the electrical signal (or electrical pulse) generator 42 to make it possible for the spray nozzle 43 of the spray system to spray the droplets 7 onto the medium 8 from a distance. At its end 2*b*, the hollow internal space in the tubular element 2 also contains an electrical power source 10 formed, for example, by a battery or indeed two optionally-rechargeable batteries making it possible, by means of a switch 11, to switch on the various electrical elements forming the writing instrument. The switch 11 may be replaced by any switch-on means that can be actuated by the user of the instrument, and, in particular, by means for detecting that the tubular element 2 is being held in the hand of the user, and, such as, for example, a capacitive sensor disposed at the outside wall 22 of the tubular element 2 and serving to detect pressure when the user takes hold of the instrument.

By way of example, the end 2*b* of the tubular element 2 may be in the form of a cap that is removably mounted on the central portion of said tubular element 2 to enable the two worn batteries 10 to be replaced with new batteries.

At its end 2*a*, the tubular element 2 also has measurement means 12 for measuring the distance between the spray head 41 and the medium 8 without making physical contact between the writing instrument and the medium 8. More exactly, the measurement means 12 are adapted to measure the distance between the spray nozzle 43 and the medium 8.

In this embodiment, the measurement means 12 are constituted by an optical system 13 which comprises, for example, an infrared light-emitting diode (LED) 13*a* which sends an incident light beam FI towards the medium 8 so as to form a light spot on said medium 8 together with a reflected light beam FR. The light spot and the reflected light beam are then analyzed by a photodiode 13*b* so as to determine the angle of inclination of the incident beam FI relative to the medium 8.

Since the distance between the photodiode 13*b* and the infrared LED 13*a* is known, and since the angle of inclination of the incident light beam FI is determined, it is then necessary merely to use simple trigonometric relationships to determine the distance between the infrared LED and the medium 8. The photodiode may be formed by an S6560 photodiode sold under the HAMAMATSU trademark.

The incident light beam FI output by the optical system 13 is directed substantially in the same direction as the direction in which the droplets of liquid are sprayed. In the example considered herein, this direction of the incident light beam coincides substantially with the longitudinal axis of the tubular element 2. Thus, the distance measured between the spray nozzle 43 and the medium also corresponds to the path followed by the droplets from the nozzle 43 to the medium 8.

In another variant embodiment, the optical system 13 may also have means for emitting a conical light beam whose axis of symmetry coincides with the longitudinal axis of the tubular element 2. The optical system then has a sensor adapted to determine the radius of the light spot formed by the conical beam on the medium 8. Since the radius of the light spot is proportional to the distance between the medium 8 and the emitter means for emitting the conical beam, it is then possible to measure in linear manner the distance between the emitter means and the medium. Similarly, if the axis of symmetry of the conical beam slopes relative to the medium, the light spot formed on the medium is no longer circular, but rather it is elliptical, and the sensor is also adapted to measure the length of the minor axis of the elliptical spot in order to measure the distance between the medium and the emitter means for emitting the conical beam. In this case, and regardless of the inclination of the writing instrument, the length of the minor axis of the elliptical spot is proportional only to the distance between the emitter means and the medium, and it is only the length of the major axis of the elliptical spot that is proportional to the angle of inclination of the conical beam.

In a variant embodiment, the measurement means 12 may also be constituted by an ultrasonic acoustic probe. In which case, the distance measured between the nozzle 43 and the medium 8 corresponds to the shortest distance between said nozzle 43 and the medium 8, independently of the angle of inclination of the writing instrument relative to the medium 8.

Figure 2:
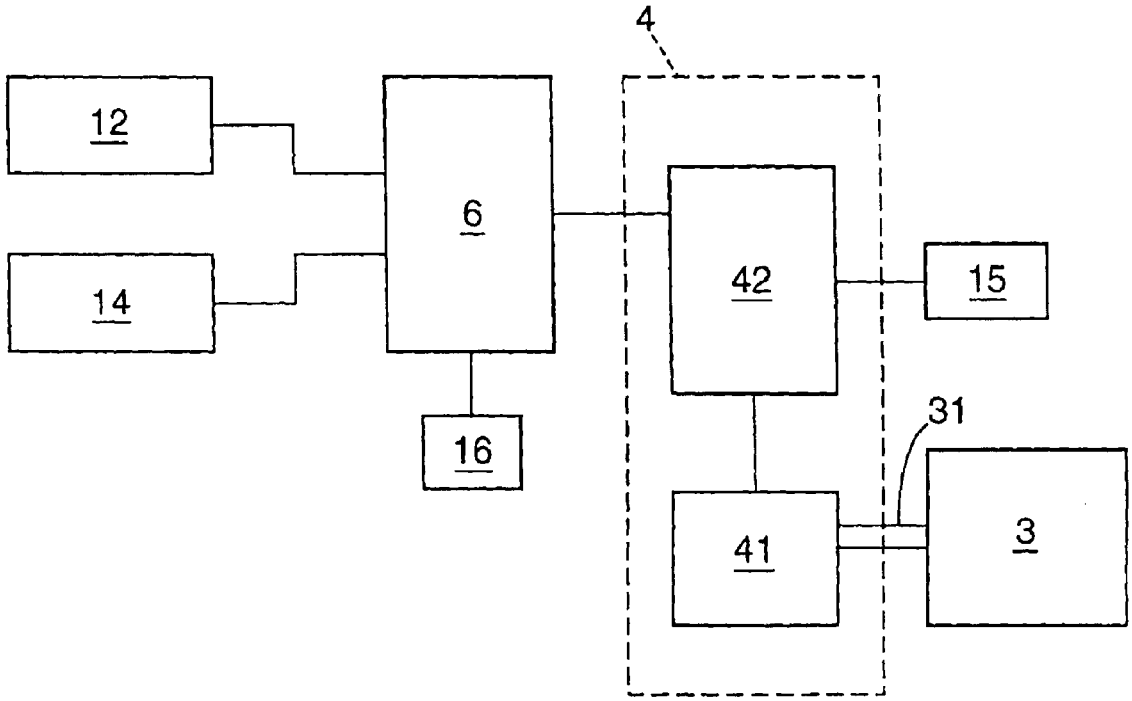
FIG. 2 is a block diagram of the various component elements of the writing instrument of the invention.

As can be seen with reference to FIGS. 1 and 2, the optical system 13 that forms the measurement means 12 is connected directly to the processor unit 6 which stores the measurement taken by the optical system 13.

The processor unit may also be adapted to cause the optical system 13 to perform repeated measurements at determined time intervals. Such time intervals could, for example, lie in the range 1 millisecond (ms) to 0.1 seconds (s).

The tubular element 2 also has movement detector means 14 for detecting movement of the spray head 41 relative to the medium 8.

In this embodiment, the movement detector means 14 may be in the form of an accelerometer connected directly to the processor unit 6. The movement detector means 14 may also be in the form of a gyroscope.

Operation of the writing instrument is described below with reference to FIGS. 1 and 2.

When the user wishes to use the writing instrument 1 to write on a medium 8, the user first switches on the various electrical elements of the writing instrument by actuating the switch 11.

The user then brings the end of the writing instrument 1 up towards the medium 8, so that the measurement means formed by the optical system 13 automatically and without coming into physical contact with the medium 8 determine the distance between the spray nozzle 43 and the medium 8. In the same way, the movement of the writing instrument towards the medium 8 is detected by the accelerometer 14 which delivers a detection signal directly to the processor unit 6.

The processor unit 6 is adapted to cause the liquid spray system 4 to be activated and therefore to cause droplets 7 to be sprayed onto the medium 8 only when both the movement detector means 14 detect movement of the writing instrument, and simultaneously the measurement means 12 formed by the optical system 13 detect that the distance between the spray nozzle 43 and the medium 8 is less than a predetermined maximum value.

The predetermined maximum value may, for example, be about 1 centimeter (cm).

Thus, when the measurement means 12 detect that the distance between the nozzle 43 and the medium 8 is greater than the predetermined maximum value, while simultaneously the detector means detect movement of the writing instrument, the processor unit 6 does not cause the spray system to be activated, and no droplets are sprayed onto the medium 8.

Similarly, the processor unit 6 does not cause droplets to be sprayed when the writing instrument is not moving, even if the nozzle 43 is at a suitable distance from the medium, i.e., at a distance less than the predetermined maximum value.

In a variant embodiment, the processor unit 6 may also be adapted to stop activation of the liquid spray system when the spray nozzle 43 is too close to the medium 8, so as to ensure that the droplets of liquid 7 are sprayed properly onto the medium. In which case, the processor unit 6 causes the liquid spray system to be activated only while the accelerometer 14 is detecting movement of the writing instrument relative to the medium, and simultaneously the optical system 13 detects that the distance between the spray nozzle 43 and the medium 8 lies in a range of values defined by a predetermined minimum value and by a predetermined maximum value.

On its outside wall 22, the tubular element 2 of the writing instrument may also be provided with selector means 15 for selecting the size of the droplets 7 so as to modulate and to modify the thickness of the line that is formed by the succession of droplets deposited on the medium 8. The selector means 15 may, in particular, be in the form of a button, e.g., a button having three positions, making it possible to obtain three different line thicknesses. The selectable-position button 15 is connected directly to the electrical signal generator 42 of the spray system 4 to vary in predetermined manner the frequency and/or the amplitude of the electrical signals sent directly to the liquid spray head 41, thereby varying in proportion both the size and the frequency of the droplets 7 sprayed onto the medium 8.

Similarly, in order to make writing more comfortable for the user, the processor unit 6 may be adapted to activate communication means 16 serving to emit a warning signal both when the optical system 13 detects that the distance between the ink spray head 41 and the medium 8 is less than a predetermined maximum value, and simultaneously the movement detector means 14 have detected no movement of the spray head 41 relative to the medium 8 over a predetermined interval of time. For example, the communication means 16 may be in the form of a visible light signal emitter or of an audible acoustic signal emitter, thereby making it possible to inform the user that the liquid spray head 41 or, more exactly, that the spray nozzle 43 is at a distance from the medium that is suitable for enabling the electrical signal generator 42 to be activated, and that any movement (even accidental movement) of the writing instrument will cause the spray system 4 to be activated, and will thus cause droplets of liquid to be sprayed onto the medium 8.

Similarly, to make writing more comfortable for the user, the processor unit 6 may be adapted to activate the communication means 16 to emit a warning signal after the liquid spray system 4 has not been activated for some given time interval (e.g., 30 seconds or one minute), and when the measurement means 12 once again detect a suitable distance between the spray head 41 and the medium 8 while simultaneously the movement detector means again detect movement of the writing instrument. In which case, the processor unit activates the communication means for two seconds, for example, so as to warn the user that liquid spraying is imminent, and, only after said time interval of two seconds has elapsed does the processor unit 6 activate the liquid spray system 4.

Figure 3:
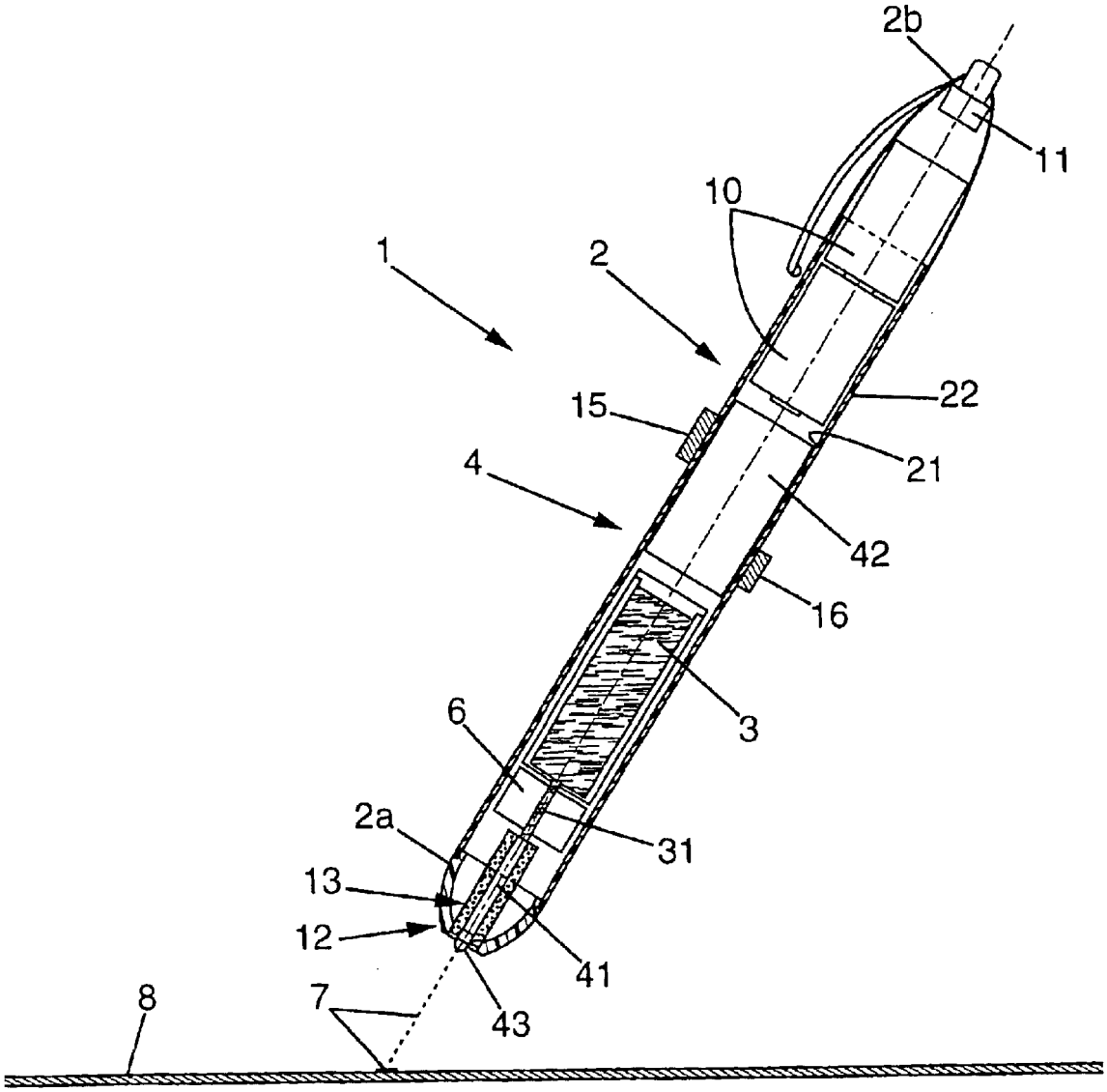
FIG. 3 is a cross-sectional view of a second embodiment of the writing instrument.

In another embodiment of the invention shown in FIG. 3, the movement detector means for detecting movement of the writing instrument are not formed by an accelerometer or a gyroscope, but rather directly by the processor unit 6 and by the measurement system 12 that also serves to determine the distance between the spray nozzle 43 and the medium 8.

As already described above, the processor unit 6 can require the measurement means 12 to perform repeated measurements at very close time intervals. In this case, the processor unit 6 can thus determine displacements of the spray head 43 relative to the medium 8 as a function of two distances measured by the measurement means 12 in a determined time interval. Such relative displacements are detected only when the spray head 41 is not displaced in a plane that is strictly parallel to the plane of the medium 8. However, when a normal user is using a writing instrument to write, the user automatically transmits imperceptible micro-tremors to the writing head, such micro-shakes then being automatically detected by the measurement means 12 and by the processor unit 6 as being movement. Whereupon, if the spray nozzle 43 is in a suitable position relative to the medium 8, the processor unit 6 triggers activation of the spray system for spraying liquid from a distance.

Depending on the embodiment, the measurement means 12 may also be constituted by the optical system 13 or by an ultrasonic acoustic probe.

When the measurement means 12 are formed by an ultrasonic acoustic probe, the end 2*a* of the tubular element 2 may also be provided with means for emitting a visible light spot onto the medium 8, the light spot serving to represent the point of impact of the droplets 7 on the medium.

What is claimed is:

1. A writing instrument comprising a substantially tubular element extending between a first end and a second end and designed to be held in a hand of a user, said tubular element comprising:

a liquid reservoir;

a liquid spray system comprising a liquid spray head coupled to said liquid reservoir, said spray head serving to spray liquid onto a medium from a distance; and a processor unit serving to activate said liquid spray system to enable said spray head to spray liquid onto the medium from a distance;

said tubular element further comprising:

measurement means coupled to said processor unit; and movement detector means coupled to said processor unit;

wherein:

said measurement means acts without physical contact between the writing instrument and the medium to measure the distance between the spray head and the medium;

said movement detector means detects movement of the spray head; and said processor unit is adapted to cause said liquid spray system to be activated when both said measurement means determine that the distance between said spray head and the medium is less than a predetermined maximum value, and simultaneously said movement detector means detect movement of said spray head.

2. An instrument according to claim 1, wherein said processor unit is adapted to cause said liquid spray system to be activated when both said measurement means determine that the distance between said spray head and the medium lies in the range defined by a predetermined minimum value and said predetermined maximum value, and simultaneously said movement detector means detect movement of said spray head.

3. An instrument according to claim 1, wherein said measurement means comprise an optical system serving to measure the distance between said spray head and the medium.

4. An instrument according to claim 3, wherein:

said movement detector means are formed by said optical system and said processor unit; and said processor unit detects displacements of said spray head relative to the medium as a function of the distances measured by said optical system.

5. An instrument according to claim 3, wherein said movement detector means comprise an accelerometer.

6. An instrument according to claim 1, wherein said measurement means comprise an ultrasonic acoustic probe serving to measure the distance between said spray head and the medium.

7. An instrument according to claim 6, wherein:

said movement detector means are formed by said acoustic probe and said processor unit; and said processor unit detects displacements of said spray head relative to the medium as a function of the distances measured by said acoustic probe.

8. An instrument according to claim 6, wherein said movement detector means comprise an accelerometer.

9. An instrument according to claim 1, wherein said tubular element includes an electrical power source and switch-on means connected to said electrical power source, said switch-on means being actuatable by the user to switch on said liquid spray system, said processor unit, and said measurement means and said movement detector means.

10. An instrument according to claim 1, wherein:

said tubular element includes means for emitting a visible light spot onto the medium so as to represent the point of impact of the liquid spray on the medium.

11. An instrument according to claim 1, wherein:

said liquid spray head comprises at least one spray nozzle for spraying droplets of liquid; and said spray system further comprises an electrical signal generator for causing said at least one nozzle of said spray head to be activated.

12. An instrument according to claim 11, wherein said tubular element has an outside wall;

said selector means are mounted on said outside wall of said tubular element;

said selector means permits selection of the size of the droplets; and said selector means is connected to said electrical signal generator of said spray system to vary the frequency and/or the amplitude of electrical signals that cause said at least one spray nozzle to be activated.

13. An instrument according to claim 1, wherein said processor unit is adapted to activate communication means to emit a warning signal to the user when both said measurement means detect that the distance between said spray head and the medium is less than a predetermined maximum value, and simultaneously said movement detector means have not detected any movement of the spray head over a predetermined time interval.

14. An instrument according to claim 1, wherein, when said liquid spray system has not been activated for a first time interval, said processor unit is adapted to activate communication means for a second time interval to emit a warning signal, and then to cause said liquid spray system to be activated when said measurement means detect that the distance between said spray head and the medium is once again less than the predetermined maximum value, and simultaneously said movement detector means detect movement of said spray head once again.

15. An instrument according to claim 1, wherein said movement detector means comprise an accelerometer.

* * * * *